US007583236B1

(12) United States Patent
Lopez

(10) Patent No.: US 7,583,236 B1
(45) Date of Patent: Sep. 1, 2009

(54) WIDEBAND COMMUNICATION ANTENNA SYSTEMS WITH LOW ANGLE MULTIPATH SUPPRESSION

(75) Inventor: Alfred R. Lopez, Commack, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/982,791

(22) Filed: Nov. 5, 2007

(51) Int. Cl.
*H01Q 9/16* (2006.01)

(52) U.S. Cl. ..... 343/820; 343/800; 343/891

(58) Field of Classification Search ..... 343/798, 343/799, 800, 890, 891, 700 MS, 727, 774, 343/778, 790, 797
See application file for complete search history.

(56) References Cited

U.S. PATENT DOCUMENTS 2,508,084 A * 5/1950 Alford ..... 343/727
2,532,551 A * 12/1950 Jarvis ..... 343/774
2,631,237 A * 3/1953 Sichak et al. ..... 343/778
2,762,045 A * 9/1956 Engel et al. ..... 343/790
5,784,032 A * 7/1998 Johnston et al. ..... 343/702
5,796,372 A * 8/1998 Elliot ..... 343/797
5,912,646 A * 6/1999 Seki et al. ..... 343/700 MS
6,819,291 B1 * 11/2004 Lackey et al. ..... 343/700 MS
6,844,851 B2 * 1/2005 Yoon et al. ..... 343/700 MS
7,119,757 B1 * 10/2006 Lopez ..... 343/816

* cited by examiner

*Primary Examiner*—James H. Cho
*Assistant Examiner*—Crystal L Hammond
(74) *Attorney, Agent, or Firm*—Kenneth P. Robinson

(57) ABSTRACT

Vertical array antenna systems can provide broadband data link operation with reduction of susceptibility to low angle multipath effects, for communication during carrier landings by aircraft and other applications. In a relatively small package, an antenna system may include a stack of sub-arrays, each including four dipoles provided as configurations of downward and upward extending dipole arm members which are vertically separated by an annular slot excited by vertical probes. Excitation of the dipoles may be provided via excitation of the annular slot by the probes. Intercoupling-reduction disk units may be positioned between vertically adjacent sub-arrays. Pattern cutoff characteristics suitable for aircraft carrier landing operations (e.g., for reliable DGPS communications) at or near the horizon may be provided by excitation of individual sub-arrays at predetermined relative levels and with pattern phase reversal between lower and upper sub-arrays. Such phase reversal may be provided by physical inversion of some sub-arrays of an antenna system. Other embodiments are described.

19 Claims, 10 Drawing Sheets

Sub-Array Excitation

| Sub-Array Number | Amplitude (Voltage Ratio (dB)) | Phase (Degrees) |
|---|---|---|
| 13 (Top) | 0 | |
| 12 | 0.127 (-17.92) | -90 |
| 11 | 0 | |
| 10 | 0.212 (-13.47) | -90 |
| 9 | 0 | |
| 8 | 0.637 (-3.92) | -90 |
| 7 | 1 (0) | 0 |
| 6 | 0.637 (-3.92) | 90 |
| 5 | 0 | |
| 4 | 0.212 (-13.47) | 90 |
| 3 | 0 | |
| 2 | 0.127 (-17.92) | 90 |
| 1 (Bottom) | 0 | |

FIG. 7

SUB-ARRAY IMPEDANCE IN ARRAY ENVIRONMENT

WIDEBAND COMMUNICATION ANTENNA SYSTEMS WITH LOW ANGLE MULTIPATH SUPPRESSION

RELATED APPLICATIONS (Not Applicable)

FEDERALLY SPONSORED RESEARCH (Not Applicable)

BACKGROUND OF THE INVENTION

This invention relates to communication antennas and, more specifically, to wideband communication antennas with reduced susceptibility to low angle multipath signal effects.

In many applications it is desirable to provide for RF data link communication over a wide band of frequencies, however, in some instances reception at low elevation angles may be affected by multipath effects, such as surface reflections. Such applications may include low angle communication with ground vehicles and other situations in which the quality of communications may be limited by multipath type fading or effects.

One particular application relates to aircraft carrier-based landing operations. Communications in this environment may be subject to degradation as a result of signal fades caused by sea surface reflections. A relatively wide bandwidth (e.g., 1350 to 1850 MHz) may be employed for the RF data link used for final approach aircraft communications. Reliability and quality of communication in this environment is made more critical in the context of the need for high dependability transmission of position related data to aircraft approaching a landing on the carrier deck. For increased accuracy of use of Global Positioning System (GPS) signals regarding aircraft position relative to the carrier deck, Differential GPS (DGPS) signals can be derived relative to the position of the aircraft carrier and transmitted to an approaching aircraft. In this way, local and other errors inherent in basic GPS signals received by the aircraft can be subjected to in-aircraft correction, by use of DGPS signals, for increased positional accuracy in the landing process. Errors addressed by use of the DGPS signals may include ionospheric, tropospheric and satellite clock and ephemeris errors. DGPS signals appropriate for this use may be provided through implementation of established techniques.

However, for such shipboard DGPS and other applications, available antennas may in operation be subject to signal fades or other degradation of performance due to multipath or other effects, as well as being subject to limitations regarding one or more of bandwidth or other limitations, excessive height or size (e.g., for carrier or vehicle installations) or other shortcomings.

Objects of the present invention are, therefore, to provide new or improved antenna systems and such antenna systems which may provide one or more of broadband operation, reduced size and reliable operation in the presence of multipath or related effects.

SUMMARY OF THE INVENTION

In accordance with an embodiment of the invention, an antenna system may include a plurality of sub-arrays positioned along a vertically extending central axis. Each sub-array may comprise:

(i) a first disk member including two main surfaces, a central opening and a first conductive configuration having a signal port and at least one signal access point;

(ii) a first dipole-component configuration coupled to and extending in a first vertical direction away from the first disk member;

(iii) a second disk member including two main surfaces and a central opening and positioned with an annular space between the first and second disk members;

(iv) a second dipole-component configuration coupled to and extending away from the second disk member in a second vertical direction away from the first disk member; and (v) at least one signal-coupling member coupled to the at least one signal access point and extending into the annular space.

This antenna system may additionally include:

a plurality of intercoupling-reduction disk units separately positioned, each between two vertically adjacent sub-arrays, and each having an annular conductive surface.

In particular embodiments, the plurality of sub-arrays of an antenna system may include a central sub-array, a plurality of upper sub-arrays positioned above the central sub-array and a plurality of lower sub-arrays positioned below the central sub-array, with the upper sub-arrays physically inverted relative to the lower sub-arrays. The antenna system may additionally include an excitation unit coupled to the signal port of each of the central, upper and lower sub-arrays and a plurality of passive sub-arrays separately positioned each between two vertically adjacent ones of the upper and lower sub-arrays, with the passive sub-arrays not coupled to the excitation unit.

In accordance with another embodiment of the invention, an antenna system may include a plurality of sub-arrays positioned along a vertically extending central axis. supported by that structure at vertically spaced positions. Each sub-array may comprise:

(i) a disk member including two main surfaces, a central opening and a first conductive configuration having a signal port and at least one signal access point;

(ii) a first dipole-component configuration coupled to and extending in a first vertical direction away from the first disk member;

(iii) a second dipole-component configuration vertically spaced from and extending away from the disk member in a second vertical direction; and (iv) at least one signal coupling member coupled to the at least one signal access point and arranged to provide excitation signals to the second dipole-component configuration.

For a better understanding of the invention, together with other and further objects, reference is made to the accompanying drawings and the scope of the invention will be pointed out in the accompanying claims.

BRIEF DESCRIPTION OF THE DRAWINGS

FIG. 7 is a sub-array excitation table useful in describing an embodiment of the FIG. 1 antenna system.

DESCRIPTION OF THE INVENTION

Figure 1:
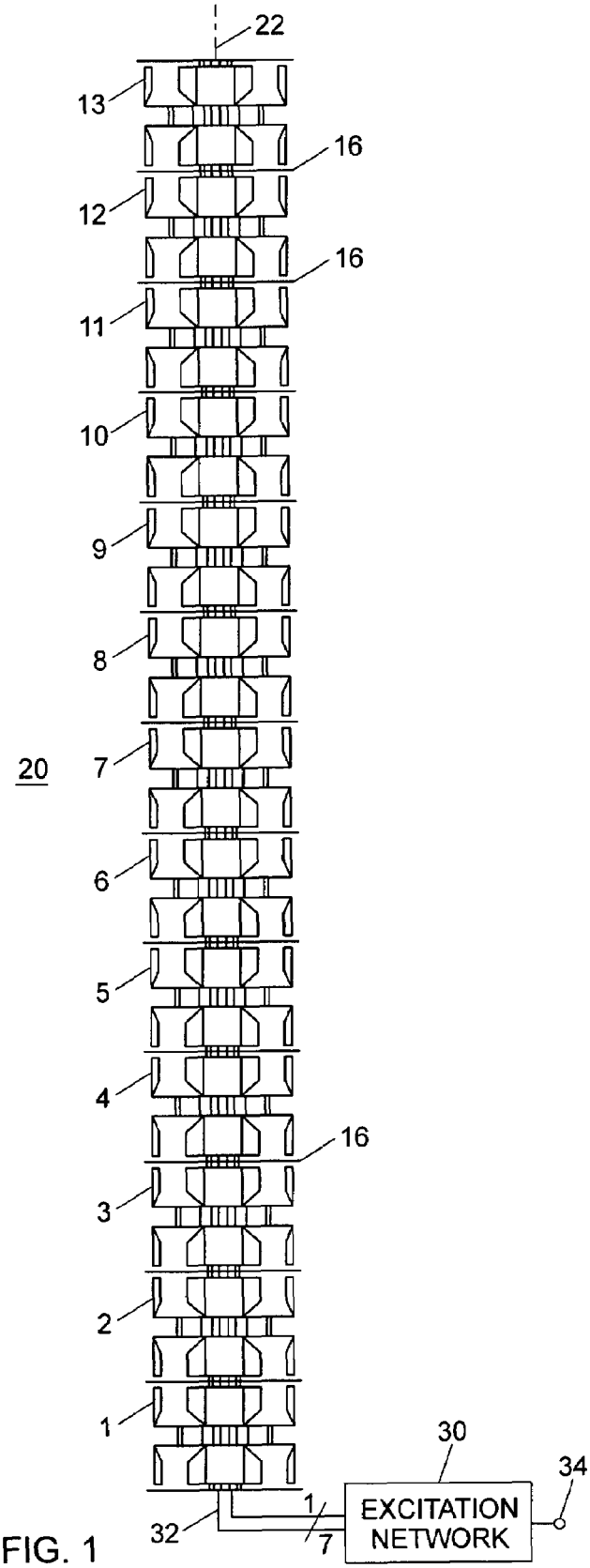
FIG. 1 shows one embodiment of an antenna system pursuant to the invention.

FIG. 1 illustrates an embodiment of an antenna system 20 in accordance with the invention. As shown, the antenna system includes a plurality of sub-arrays 1-13 positioned along a vertically-extending central axis 22. In this example, axis 22 passes centrally through the sub-arrays 1-13 and is visible only at its upper terminus.

Figure 2:
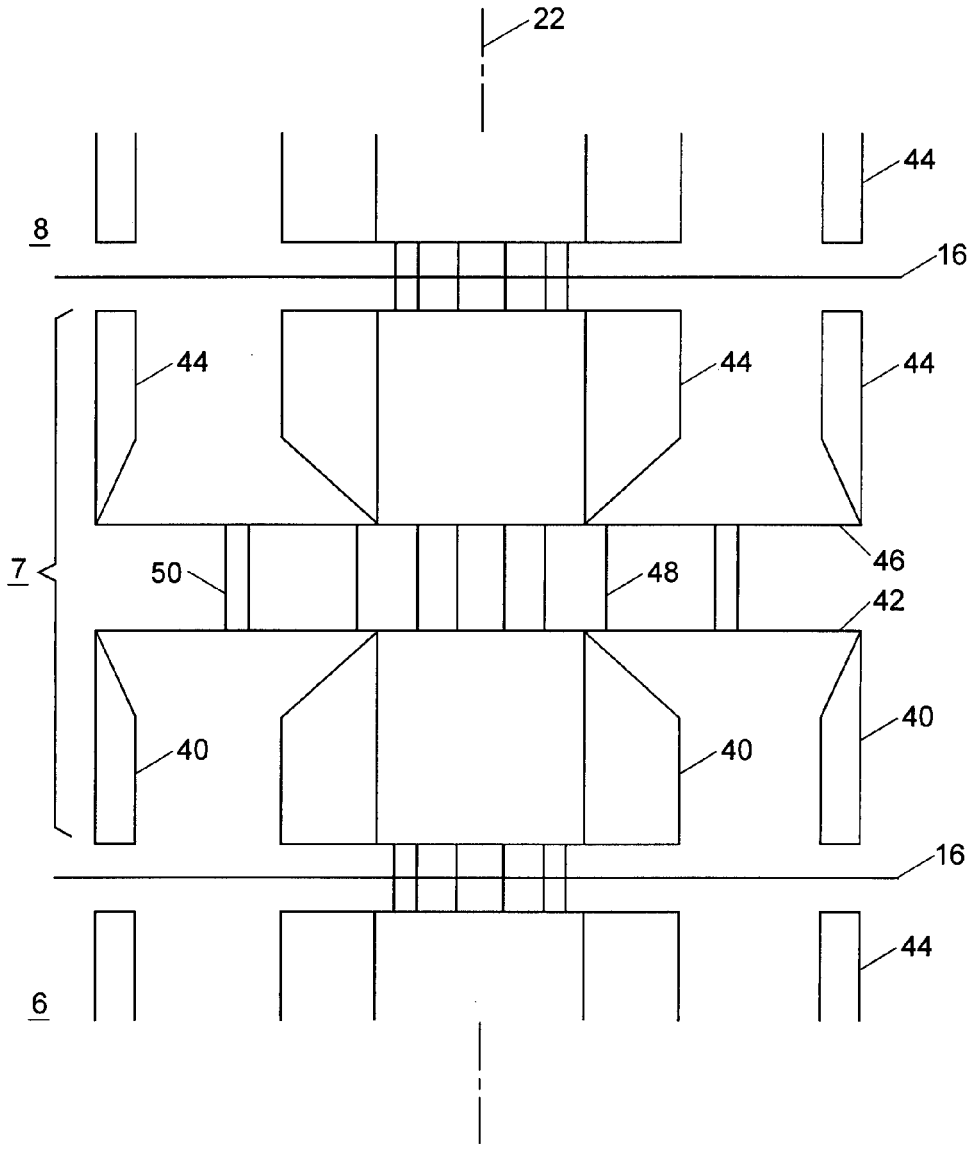
FIG. 2 is an enlarged view of a central portion of the FIG. 1 antenna system including the central sub-array.
Figure 3:
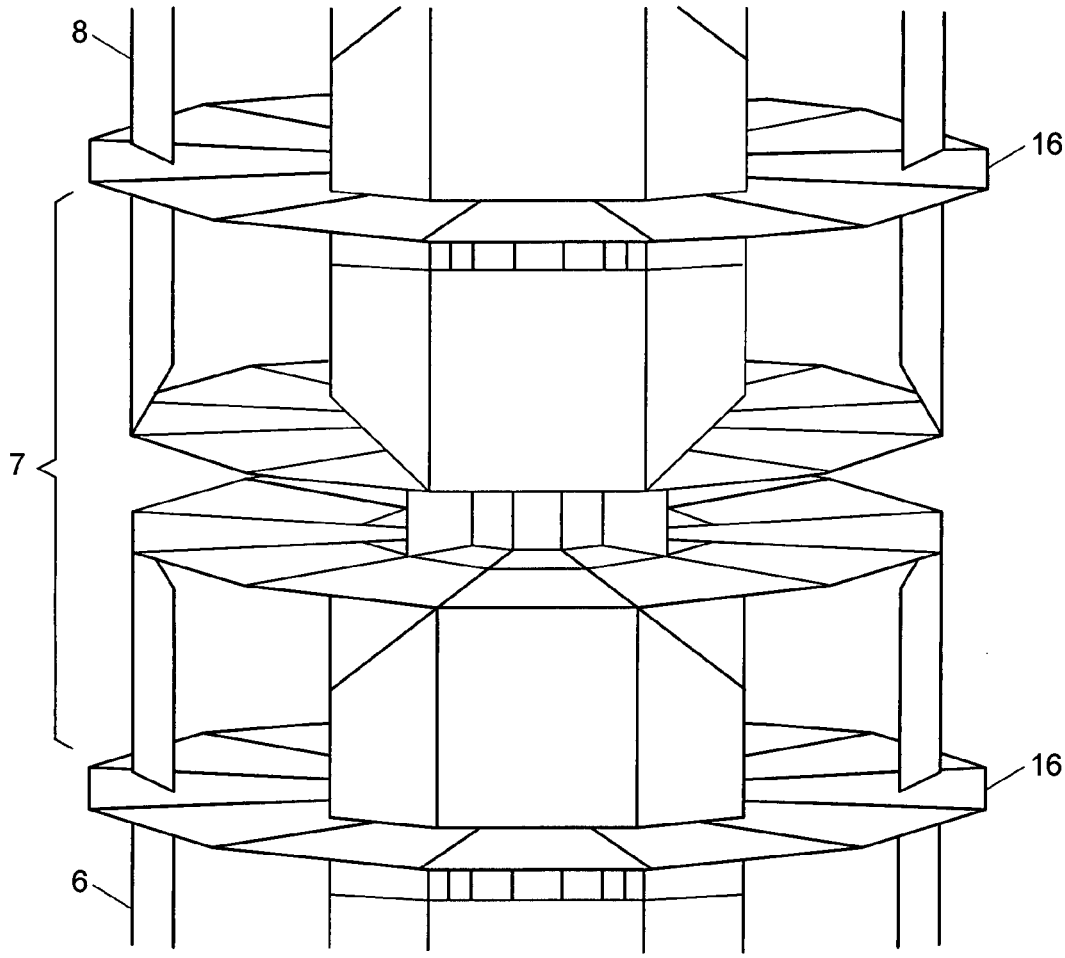
FIG. 3 is a type of three-dimensional view of the same antenna system portion as in FIG. 2.
Figure 4:
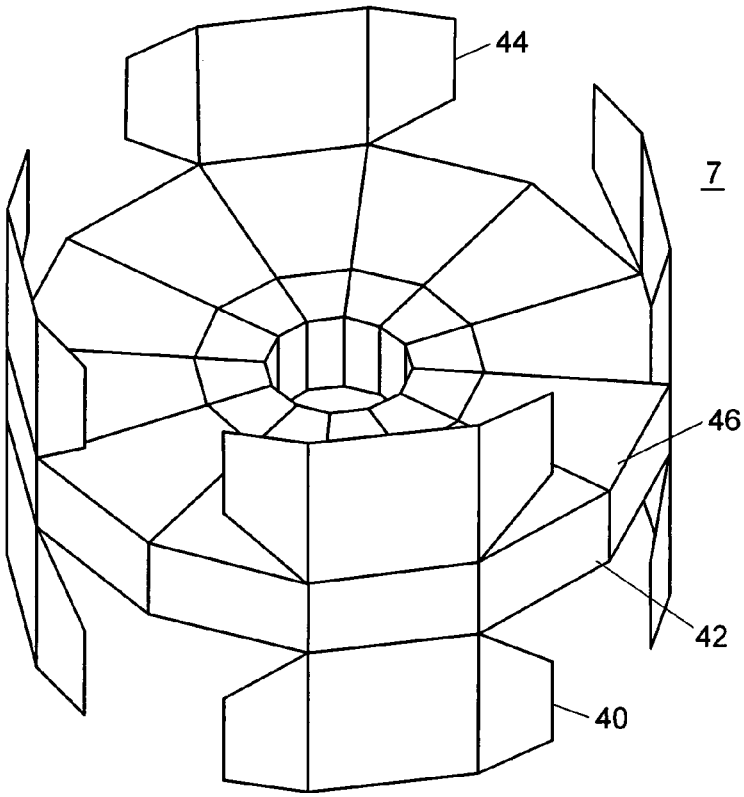
FIG. 4 is a three-dimensional view of only the central sub-array of FIG. 2.

Sub-arrays 1-13 may be of identical construction, except that in this embodiment sub-arrays 1, 3, 5, 9, 11 and 13 are passive elements as will be further described. Referring to FIG. 2, there is shown an enlarged view of sub-array 7, with portions of adjacent sub-arrays 6 and 8. FIG. 3 is a type of three dimensional view of the same subject matter as FIG. 2. FIG. 4 is a 3D type view of sub-array 7 by itself. As will be described further, each sub-array comprises four vertically aligned dipoles in this embodiment. A first dipole-component configuration comprises four dipole arm members 40 which extend downward from first disk member 42. A second dipole-component configuration comprises four dipole arm members 44 which extend upward from second disk member 46. Four signal-coupling members 50, shown as vertical exciters or probes, extend into the annular space between disk members 42 and 46. Exciters 50 are used, in conjunction with conductive patterns of the disk members 42 and 46 to provide excitation to an annular slot and equal strength excitation to all four dipoles with the same phase of excitation for all four dipoles. In this configuration, each dipole arm member 40 has a vertically aligned associated dipole arm member 44 which together function as a vertical dipole (with the two respective arm members 40 and 44 of each dipole arranged to receive out of phase signal excitation as typically employed in dipole operation). It should be noted that sub-arrays 8, 10, 12 of FIG. 1 are physically inverted (turned upside down relative to sub-arrays 2, 4, 6) in this embodiment, so that while dipole arms 40 of sub-arrays 2, 4, 6 and 7 are downward extending, dipole arms 40 of sub-arrays 8, 10, 12 are upward extending. Correspondingly, in this embodiment dipole arms 44 of sub-arrays 8, 10, 12 are downward extending and dipole arms 44 of sub-arrays 2, 4, 6 and 7 are upward extending. This sub-array inversion provides a relative phase reversal of sub-array radiation patterns, as will be further described.

Figure 5:
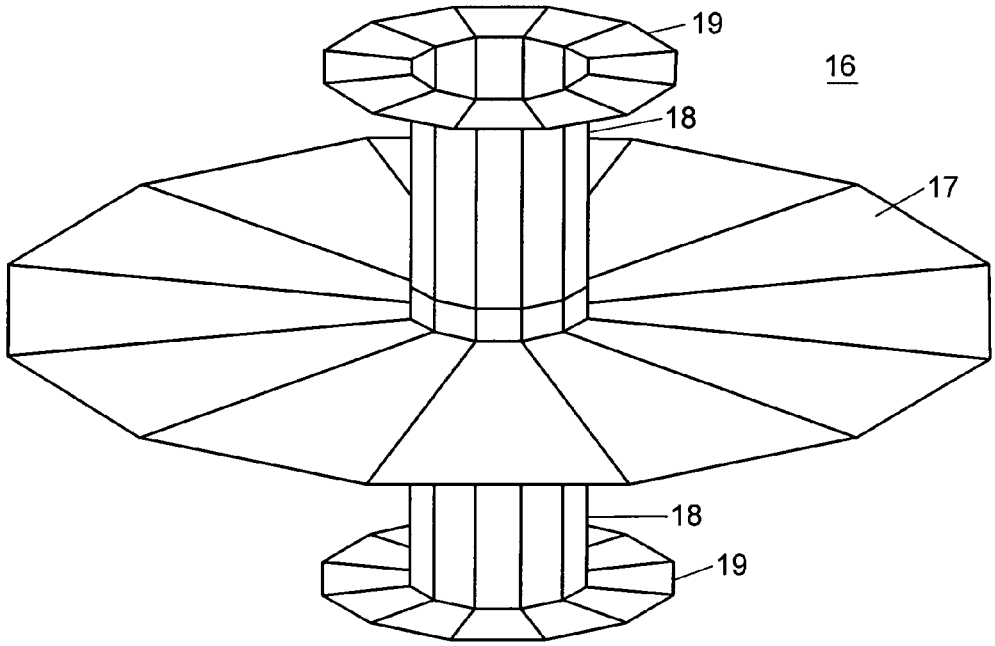
FIG. 5 is a three dimensional view of an intercoupling-reduction disk unit as included in the FIG. 1 antenna above and below the central sub-array of FIG. 4.

As shown in FIGS. 1, 2 and 3, antenna system 20 further includes a plurality of intercoupling-reduction disk units 16 separately positioned, each between two vertically adjacent sub-arrays. In this configuration there are included fourteen of the disks units 16, which are positioned along central axis 22 and each have an annular conductive surface. FIG. 5 is a 3D type view of intercoupling-reduction disk unit 16, which may be constructed of conductive metal, of other material carrying a conductive surface or be of other suitable construction. As shown, disk unit 16 has an annular conductive surface 17 and upper lower and lower cylindrical portions 18, each with an end flange portion 19. With this construction disk unit 16 provides dual functions. First, it provides an annular conductive surface 17 configured for reduction of mutual coupling effects between adjacent sub-arrays. Second, via portions 18 and 19, it provides for supporting and spacing adjacent sub-arrays with predetermined spacings between the sub-arrays and conductive surface 17. In other configurations, disk unit 16 may comprise conductive surface 17 (e.g., a metal disk) with other suitable arrangements for supporting surface 17 and supporting and spacing the sub-arrays. In the FIG. 1 configuration, all of the fourteen disk units 16 may be identical, except that the upper portions 18 and 19 of the top disk unit and the lower portions 18 and 19 of the bottom disk unit may not be present. In other embodiments, the top and bottom disk units 16 may be omitted and the disk units may be of any suitable form and construction. For present purposes, the term "disk" is used to refer to a relatively thin element having a perimeter which may be circular, 12-sided as shown, or of any other shape, as may be appropriate in particular applications. For purposes of illustration, portions of the FIG. 5 intercoupling-reduction disk unit 16 are illustrated without thickness, while of course all portions of all antenna elements will have finite thickness.

The FIG. 1 antenna system 20 further includes an excitation unit 30, shown as an excitation network. As indicated in FIG. 1, seven conductors or cables represented at 32 are coupled from excitation unit 30 to provide an individual coupling to the signal port of each of sub-arrays 2, 4, 6, 7, 8, 10 and 12. In this embodiment the line lengths of the cables 32 are the same for each of those sub-arrays, to provide improved broadband performance. Excitation unit 30 includes an input/output port 34 and may be provided in the form of a seven-way power divider/combiner or in other suitable form by skilled persons. Antenna system 20 may also include a protective radome (not shown) of cylindrical or other form constructed of material with suitable signal transmissive, structural strength and antenna system protective properties, as may be determined by skilled persons. In this manner both structural protection and protection from salt water spray and other atmospheric effects may be provided. While signal transmission terminology may be used for convenience of description, it will be understood that antennas and antenna elements generally operate reciprocally for signal reception or transmission.

With reference more particularly to FIGS. 2 and 4, each of sub-arrays 1-13 in this embodiment may comprise the following, described with reference to the centrally-located sub-array 7 by way of example.

(i) A first disk member 42 includes two main surfaces (upper and lower), a central opening through which central axis 22 passes. Disk member 42 and other components of sub-array 7 may be mechanically coupled to vertically adjacent components to provide a vertical structure. Thus, sub-arrays 1-13 are effectively arranged in a stack with the disk units 1 interspersed in this configuration.

Figure 6:
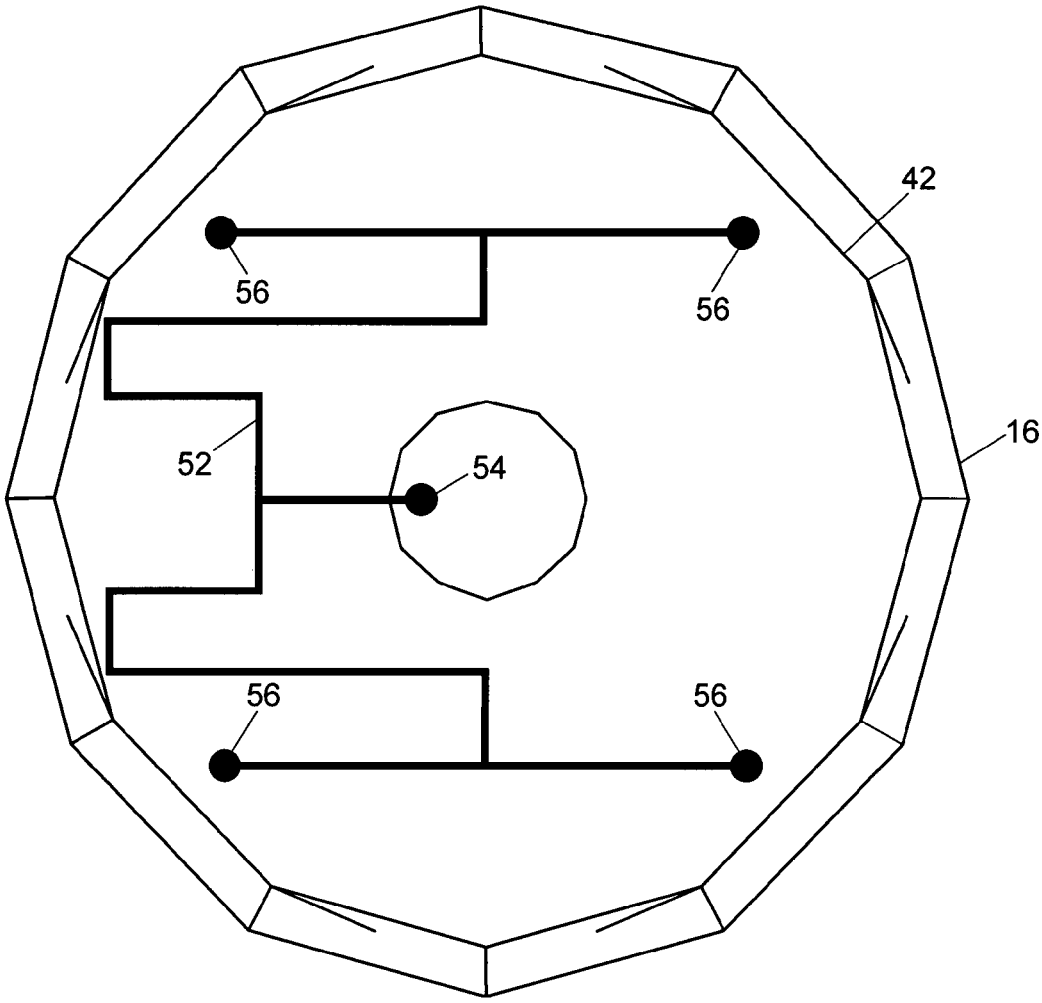
FIG. 6 illustrates a circuit configuration provided via a conductive configuration included in the FIG. 4 central sub-array and FIG. 6A is a related partial cross-sectional view.
Figure 6A:
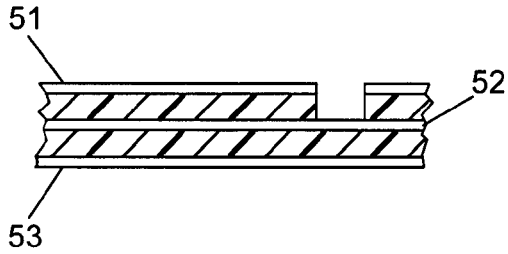

In a presently preferred implementation, first disk member 42 may comprise a multi-layer construction including a middle first conductive configuration, in the form of a stripline circuit insulatively separated from upper and lower conductive layers. As shown stripline configuration 52 may cover all or most of the respective upper or lower surfaces of disk member 42. A representation of an exemplary electrical format of the first conductive configuration (e.g., stripline circuit) is provided in FIG. 6. As shown in FIG. 6, stripline circuit 52 includes a signal port 54 and at least one signal access point 56 (in this example, four equally spaced signal access points 56). Signal port 54 may be implemented as a connection point or coaxial connector arranged to enable connection of one of the cables 32 shown in FIG. 1 as coming from excitation unit 30, to enable coupling of input and output signals. Cables 32 may pass from unit 30, through the central openings of appropriate ones of the sub-arrays and disk units, with each cable coupled to the signal port 54 of one active sub-array in this configuration. Access points 56 may be implemented as connection points arranged to enable soldered or other coupling to (e.g., the lower ends of) the signal coupling members 50 (e.g., vertical exciters). FIG. 6 thus represents a view upward to the bottom of a configuration of first disk member 42 with one of the conductive layers and associated insulative material removed in order to expose the stripline circuit 52 (with the edge of a disk unit 16 visible above the sub-array). FIG. 6A is a cross-sectional view of a small expanded portion of the stripline arrangement, showing first conductive configuration 52 separated from upper and lower conductive layers 51 and 53 by insulative layers.

In the FIG. 6 embodiment, the first conductive configuration has the form of a stripline circuit configuration 52 incorporating a four-way power divider arranged to couple same phase, equal amplitude portions of an input signal, from excitation unit 30, to the four signal access points 56. Coupling of an input signal (to be transmitted by the antenna system) is referred to, however reciprocity applies so that received signals may be combined and coupled to the signal port 54. Stripline techniques, design and implementation are well known and may be implemented by skilled persons as appropriate for particular applications and may be arranged to provide a 50 Ohm impedance at signal port 54 and a 90 Ohm impedance at access points 56, for example. In this configuration as described, first disk member 42 includes upper and lower conductive layers, as well as the middle layer stripline circuit. For passage of the vertical exciters 50 upward from respective access points 56 of the stripline circuit, as shown in FIG. 6A the upper conductive layer 51 of first disk member 42 may include clearance openings to avoid electrical contact with the exciters 50 or be otherwise suitably configured.

In the particular example illustrated in FIG. 6, the four-way power divider is a reactive power divider with the following design characteristics. Pairs of the signal access points 56 (i.e., two upper and two lower, as shown) are connected via 95 Ohm stripliners to a junction point where the impedance is 45 Ohms. From each such junction point a two section quarter-wavelength transformer is used to transform from 45 to 100 Ohms, so that the junction of these two transformers provides an impedance level of 50 Ohms and this junction is connected to the signal port 54 by a 50 Ohm transmission line. For this configuration, each of the two section transformers uses a quarter wavelength of 54.9 Ohm line to transform from 45 to 67.1 Ohms and a quarter wavelength of 81.9 Ohm line to transform the impedance level from 67.1 to 100 Ohms.

Each sub-array may also comprise the following items (ii) through (v).

(ii) A first dipole-component configuration, which comprises in this embodiment the four dipole arm members 40, which extend in a first vertical direction (e.g., downward as shown) from the first disk member 42. The lower conductive layer 53 of first disk member 42 is coupled to and provides mechanical connection to the lower dipole arms 40 of sub-array 7 in this embodiment. Thus, for sub-array 7, lower dipole arms 40 extend down from the lower conductive surface of first disk member 42. As illustrated, in the assembled antenna system the dipole arm members are at positions spaced from and around the central axis 22, which is represented in FIG. 1. (As noted, while arm members 40 extend downward for sub-array 7, they extend upward for sub-arrays 8, 10, 12, as well as 9, 11, 13, in this embodiment.) Arm members 40 (and 44) may be of any suitable form and shape as determined by skilled persons to provide suitable antenna characteristics in particular applications.

(iii) A second disk member 46, which includes two main surfaces (upper and lower), a central opening, through which central axis 22 passes, and a second conductive configuration. In this embodiment, the second conductive configuration may take the form of a uniform metallic layer (e.g., disk member 46 may consist of a metal disk). In other embodiments, second disk member 46 may be of multi-layer construction (e.g., as described with reference to the first disk member 42) and may include a stripline circuit configured for providing a sub-array tuning capacitance to optimize performance or for other suitable purpose.

Second disk member 46 is positioned with an annular space between the first and second disk members 42 and 46. In this configuration the annular space is determined by a cylindrical spacer 48 which may be of honeycomb, foam or other suitable construction. With this configuration, the annular space between disk members 42 and 46 is suitably dimensioned to form an annular slot (radially extending slot) which, when provided with excitation, also provides excitation to the dipole arm members 40 and 44.

(iv) A second dipole-component configuration, which comprises in this embodiment the four dipole arm members 44, which extend in a second vertical direction (e.g., upward) away from the first disk member 42. In this example, since dipole arm members 44 are characterized as extending away from first disk member 42, by definition they extend upward (the second vertical direction) and the dipole arm members 40 which extend in a first vertical direction extend downward, as illustrated. Arm members 44, in this embodiment; are coupled to the second conductive configuration of second disk member 46 for purposes of dipole excitation. Structural support of the arm members may also be provided via such coupling or in other suitable manner. It will be appreciated that, while in the present configuration of the second disk member 46 its second conductive configuration may simply consist of a metal disk, in other embodiments it by be of multi-layer construction including an upper conductive layer to which the dipole arms are coupled, or be of other suitable construction.

(v) At least one signal-coupling member 50. In this embodiment, four signal-coupling members, of which 50 is typical, are individually coupled to each of the four signal access points 56 of the first conductive configuration (e.g., stripline circuit 52 of the first disk member), extend into the annular space between the first and second disk members 42 and 46, and may be stabilized at the top by being coupled in an insulated, non-conductive manner to second disk member 46 (e.g., by use of an insulative sleeve or cap, etc.). For purposes of excitation of dipole arm members 40 and 44 in this embodiment, the signal-coupling members may thus comprise exciters or probes arranged for excitation of the annular slot (i.e., the annular space around spacer 48, as shown in FIG. 2). In other embodiments different configurations of signal-coupling members suitable to the application may be provided by skilled persons.

The FIG. 1 antenna system includes sub-arrays 1-13, of which center sub-array 7 is typical as discussed. In this embodiment only seven sub-arrays (sub-arrays 2, 4, 6, 7, 8, 10 and 12) are arranged for excitation via equal length cables coupled to excitation unit 30. Sub-arrays 1, 3, 5, 9, 11 and 13, which may be of identical or other suitable configuration, may be considered to be passive or dummy sub-arrays. While not electrically connected to unit 30, these sub-arrays provide an antenna pattern effect which improves elevation pattern characteristics. In other embodiments sub-arrays 1, 3, 5, 9, 11 and 13 may be determined to be unnecessary in providing the required performance and some or all of these passive elements may be omitted from the antenna system. The number of sub-arrays utilized and their excitation, the inclusion and number of passive sub-arrays utilized, the inclusion and number of disk units and other antenna system features may be as determined by skilled persons as appropriate for particular implementations. For a design of the FIG. 1 antenna system configuration, sub-array to sub-array spacing was 3.111 inches, nominal antenna system height and diameter were 40 inches and 5 inches, respectively, with computer determined omni-directionality better than plus or minus 0.25 dB.

FIG. 7 sets out relative amplitude and phase of excitation for a currently preferred implementation of the FIG. 1 antenna system. As shown, with excitation of center sub-array 7 at a reference level of 1 (e.g., zero dB) and a zero degree reference phase, successively spaced pairs of the active sub-arrays have reduced excitation levels (e.g., sub-arrays 6 and 8 at 0.637 voltage ratio (−3.92 dB), etc.). For purposes of reference, sub-array 7 may be considered the center sub-array, with the other active sub-arrays designated as: 2-bottom lower, 4-middle lower, 6-top lower, 8-bottom upper, 10-middle upper and 12-top upper. As indicated in FIG. 7, the lower sub-arrays 2, 4, 6 provide a positive 90 degree radiation pattern excitation, while the upper sub-arrays 8, 10, 12 provide a negative 90 degree radiation pattern excitation. In the present embodiment, each sub-array has symmetry, with respect to a centered horizontal plane, for radiation pattern purposes. Consistent with that, same phase excitation signals can be provided via excitation unit 30 to the signal ports of each of active sub-arrays 2, 4, 6 and 8, 10, 12. Then, with sub-arrays 8, 10, 12 physically rotated to an inverted or upside-down alignment (relative to sub-arrays 2, 4, 6) and positioned along central axis 22, the radiation pattern associated with the dipoles (formed by the upward and downward extending dipole arm members 44 and 40) of sub-arrays 2, 4, 6 will have a phase characteristic 180 degrees different relative to the radiation pattern of the inverted dipoles (with dipole arm members 40 extending upward and dipole arm members 44 extending downward) of sub-arrays 8, 10 12. With this arrangement, excitation network need only provide excitation signals of one phase for sub-arrays 2, 4, 6, 8, 10, 12 and of a relative zero degree phase for sub-array 7, in order to achieve the relative 0, plus 90 and minus 90 degree radiation pattern phases shown in FIG. 7. The horizontal symmetry of each sub-array thus enables a 180 degree radiation pattern phase shift (e.g., for sub-array 8 relative to sub-array 6) which is fully frequency independent for operation over a broad frequency band, since there is no dependence upon phase shifting circuit components to achieve this phase differential. Passive sub-arrays 9, 11, 13 may also be inverted if desired for consistency of assembly with sub-arrays 8, 10, 12, however with respect to operation and the radiation pattern such inversion will typically not be significant.

Figure 8:
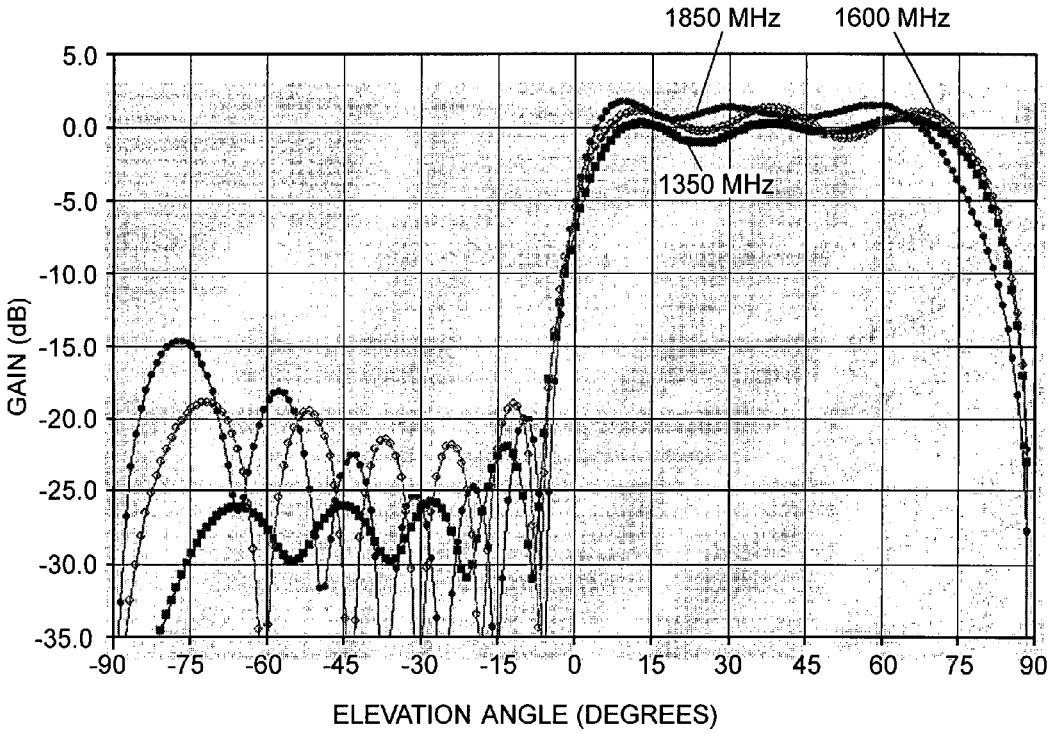
FIG. 8 is a computer plot of radiation pattern data for elevation angles at different frequencies.
Figure 9:
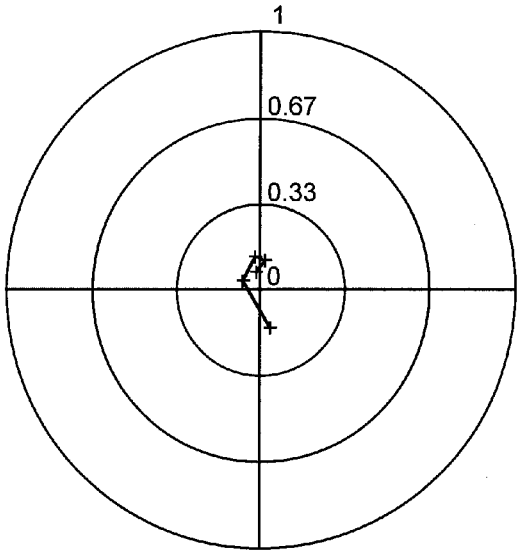
FIG. 9 is a computer plot for one sub-array in an antenna system environment, showing VSWR over a range of frequencies.

FIG. 8 provides plots of computer-generated elevation pattern data for the FIG. 1 antenna system. Curves for 1350, 1600 and 1850 MHz are identified on the right side of FIG. 8. The respective curves are not readily differentiated from each other on the left side of FIG. 8, however, the sharp drop-off in gain at and below zero degrees elevation is clearly shown. FIG. 9 is a computer generated plot of impedance of a single sub-array operating in the environment of the FIG. 1 antenna system. The curve as shown represents a VSWR below 1.5 for frequencies from 1350 to 1850 MHz.

Figure 10:
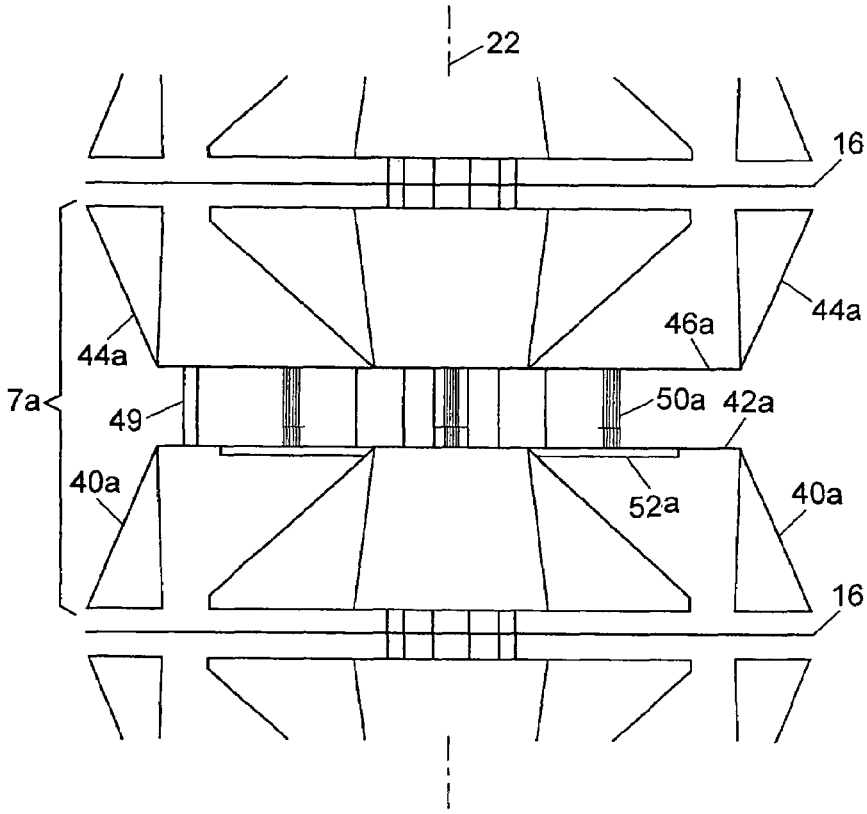
FIG. 10 is a view similar to FIG. 2, showing the central portion of a second embodiment of an antenna system pursuant to the invention.
Figure 11:
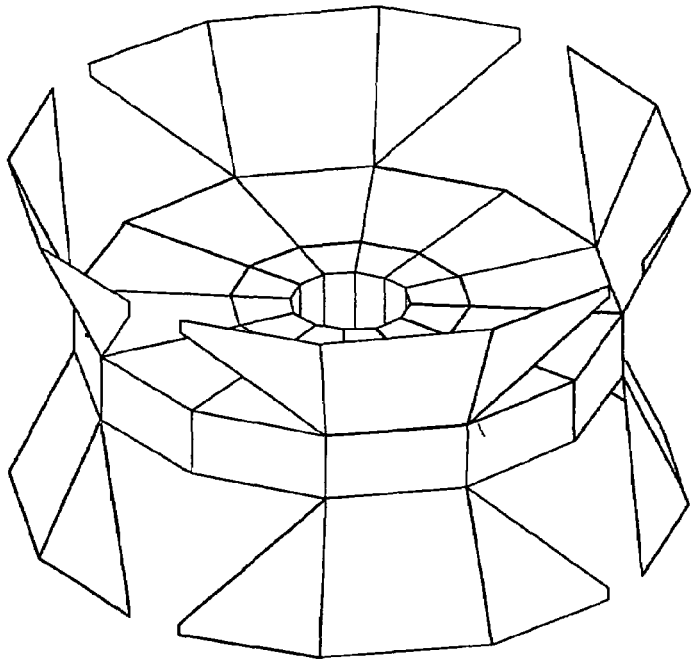
FIG. 11 is a three-dimensional view of only the central sub-array of FIG. 10.

FIG. 10 shows a second embodiment of the subject matter of FIG. 2 and FIG. 11 is a 3D type of view of central sub-array 7*a* of FIG. 10.

As configured, the use of sub-array 7*a* enables construction of antenna systems operable over a wider frequency range of 960 to 1850 MHz. The principal distinguishing feature of sub-array 7*a*, in addition to a somewhat larger overall diameter, is the design of the configurations of the four downward and four upward extending dipole arm members 40*a* and 44*a* respectively. As shown in FIGS. 10 and 11, the arm members 40*a* and 44*a* are shaped differently than the arm members 40 and 44 of FIG. 2 and extend outward beyond the outer diameters of the disk members 42*a* and 46*a*.

Basic mechanical construction of the FIG. 10 and FIG. 2 sub-arrays may be the same or similar or may be suitably changed or adapted for particular implementations, as determined by skilled persons having an understanding of the invention. More particularly illustrated in FIG. 10 is the location of stripline assembly 52*a* positioned on the lower surface of disk member 42*a*. Stripline assembly 52*a* may be as described with reference to stripline assembly 52 of FIG. 6, with probe connection points connected to the excitation probes, one of which is identified as 50*a* in FIG. 10. Also shown in FIG. 10 is a support post 49 which may be arranged to mechanically connect disk members of each sub-array for structural stability purposes in the antenna systems of FIGS. 1 and 10 (although not specifically illustrated in the FIG. 2 portion of the FIG. 1 system). Eight or other number of support posts 49 may be employed at spaced positions (e.g., at 45 degree intervals) around central axis 22 for structural purposes, while having very minor effect on electrical performance of the antenna system. Thus, although eight support posts may be employed, only one representative support post 49 is shown in FIG. 10.

Figure 12:
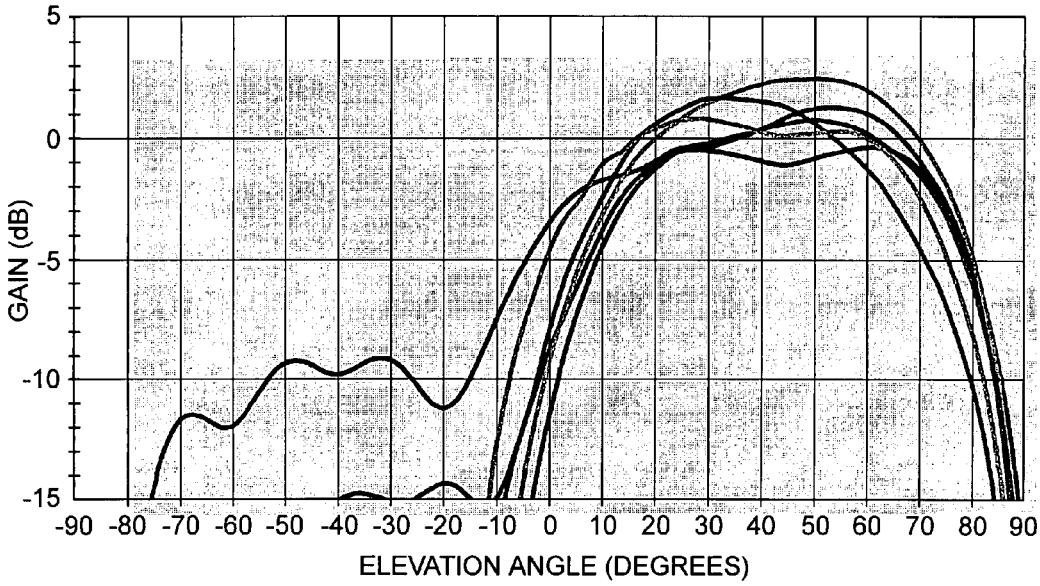
FIG. 12 is a computer plot of radiation pattern data for elevation angles at different frequencies for an antenna system configured in accordance with FIG. 10.
Figure 13:
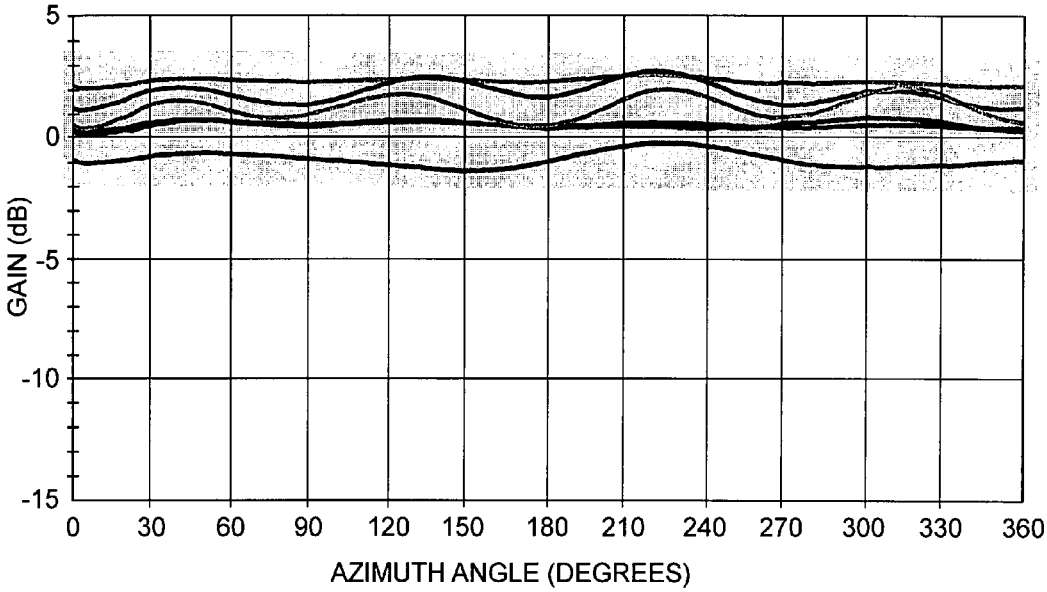
FIG. 13. is a computer plot for one sub-array in the environment of an antenna system configured in accordance with FIG. 10, showing VSWR over a range of frequencies.

FIG. 12 provides plots of computer-generated elevation pattern data for frequencies of 960, 1405 and 1850 MHz for an antenna system using thirteen of the sub-arrays as shown in FIG. 10, in a FIG. 1 type stacked configuration including interspersed intercoupling-reduction disk units similar or identical to disk units 16 described above. The curves for the different frequencies are not individually labeled as they are closely similar as shown (the curve for 1850 MHz exhibits a somewhat higher −60 to −90 degree gain characteristic as shown). FIG. 13 is a computer-generated plot of impedance of a single FIG. 10 sub-array operating in a FIG. 1 type stacked configuration employing FIG. 10 sub-arrays. The curve as shown represents a VSWR below 1.9 for frequencies from 960 to 1850 MHz.

Figure 14:
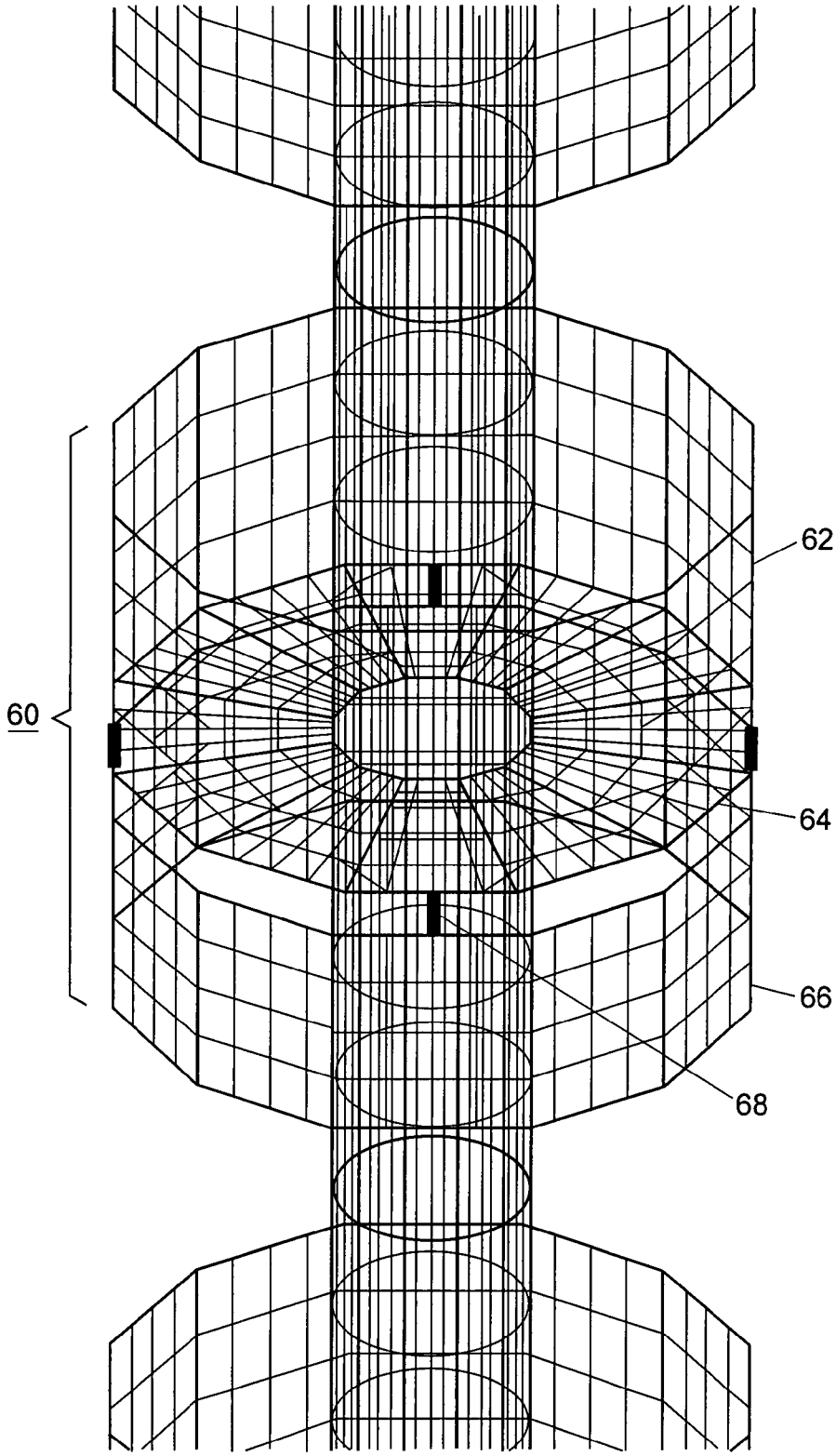
FIG. 14 shows a three-dimensional mesh-type representation of a central portion of a third embodiment of an antenna system pursuant to the invention.

A third embodiment of a sub-array 60 usable in an antenna system in accordance with the invention is shown in FIG. 14 in a mesh-type 3D view. In this embodiment, (shown without inclusion of intercoupling-reduction disk units 16 of FIG. 1) the upper portion has a cup-like form with a first dipole-component configuration 62, shown as an upper ring member radiating element, coupled to an upper conductive layer of disk member 64. Disk member 64 may include a stripline circuit incorporating a four-way power divider arranged to provide excitation of the lower portion of the sub-array 60. The lower portion spaced below disk member 64 includes a second dipole-component configuration 66, shown as a lower ring member. Couplings 68 shown at four perimeter points provide opposite phase excitation of the lower ring member via coupling to the stripline center conductor of disk member 64. For this purpose, a four-way power divider may be implemented via stripline techniques as discussed above to provide in-phase signals to four signal access points (e.g., as described with reference to FIG. 6). The signal access points are coupled to the lower ring member via the perimeter couplings 68. Embodiments of this type may provide excellent radiation pattern characteristics, however, properties of such characteristics may affect usability of sub-array 60 in an inverted alignment (as discussed above for the FIG. 1 antenna system). Without use of physically inverted sub-arrays in combination with non-inverted sub-arrays, implementation of sub-array excitation phasing such as shown in FIG. 7 may require an excitation network to include a seven-way power divider arrangement capable of providing 180 degree out of phase excitation signals for some of the sub-arrays. With the inversion of sub-arrays as employed in the FIG. 1 antenna system, frequency-independent phase reversal of radiated patterns is achieved without requiring a power divider with this capability. Antenna systems employing sub-arrays of a configuration such as illustrated in FIG. 14 may generally employ physical arrangements and operational aspects consistent with those as described relative to the FIG. 1 antenna system, as appropriate, or other suitable arrangements as may be determined by skilled persons.

Operationally, based upon both computer analysis and measured test data, antenna systems employing the invention can provide a greater than 20 dB up/down ratio at a 3 degree elevation/landing approach angle. Including an estimated 7 dB sea reflection value for a 3 degree grazing angle, the applicable up/down ratios at 3 degrees elevation were estimated at 21.7 dB for 1350 MHz, 25.4 dB for 1600 MHz and 29.8 dB for 1850 MHz signal transmissions. Calculations indicate that with an effective up/down ratio exceeding 20 dB for low angles, an antenna pattern lobing degradation factor will not exceed 1 dB. With this performance, and with the FIG. 1 antenna system being implementable in a cylindrical form within a diameter of about six inches and a height of only about 40 inches for these frequencies, there are provided antenna system size and performance characteristics generally not previously available. In particular, the present antenna systems may provide a quality and reliability of performance for DGPS aircraft carrier applications not previously available. For other frequency bands for other applications the described antenna system may be suitably scaled and adapted.

While there have been described currently preferred embodiments of the invention, those skilled in the art will recognize that other and further modifications may be made without departing from the invention and it is intended to claim all modifications and variations as fall within the scope of the invention.

What is claimed is:

1. An antenna system comprising:

a plurality of sub-arrays positioned along a vertically extending central axis, each sub-array comprising:

(i) a first disk member including two main surfaces, a central opening and a first conductive configuration having a signal port and at least one signal access point;

(ii) a first dipole-component configuration coupled to and extending in a first vertical direction away from said first disk member;

(iii) a second disk member including two main surfaces and a central opening and positioned with an annular space between the first and second disk members;

(iv) a second dipole-component configuration coupled to and extending away from said second disk member in a second vertical direction away from said first disk member; and (v) at least one signal-coupling member coupled to said at least one signal access point and extending into said annular space.

2. An antenna system as in claim 1, additionally comprising:

a plurality of intercoupling-reduction disk units separately positioned, each between two vertically adjacent sub-arrays, and each having an annular conductive surface.

3. An antenna system as in claim 1, wherein said annular space between the first and second disk members is configured as an annular slot excited by said at least one signal coupling member and arranged to couple signals to said first and second dipole-component configurations.

4. An antenna system as in claim 1, wherein:

said at least one coupling member comprises four vertical exciters; and said first conductive pattern comprises a four-way power divider configuration coupled to four said signal access points, which are each coupled singly to one of said exciters.

5. An antenna system as in claim 1, wherein:

said first and second dipole-component configurations are arranged to together provide four dipoles, each said dipole having upward and downward extending arm members; and said first conductive configuration, with said at least one signal-coupling member, are configured to provide excitation of said annular space to couple same phase excitation signals to each of said four dipoles.

6. An antenna system as in claim 1, wherein said plurality of sub-arrays includes a central sub-array, a plurality of upper sub-arrays positioned above the central sub-array and a plurality of lower sub-arrays positioned below said central sub-array, with the upper sub-arrays physically inverted relative to the lower sub-arrays.

7. An antenna system as in claim 6, additionally comprising:

an excitation unit coupled to said signal port of each of said central, upper and lower sub-arrays; and a plurality of passive sub-arrays separately positioned each between two vertically adjacent ones of said upper and lower sub-arrays;

said passive sub-arrays not coupled to said excitation unit.

8. An antenna system comprising:

a plurality of sub-arrays positioned along a vertically-extending central axis, each sub-array comprising:

(i) a first disk member including two main surfaces, a central opening and a first conductive configuration having a signal port and at least one signal access point;

(ii) a first dipole-component configuration comprising four dipole arm members coupled to and extending in a first vertical direction away from said first disk member at positions spaced from and around said central axis;

(iii) a second disk member including two main surfaces and a central opening and positioned with an annular space between the first and second disk members;

(iv) a second dipole-component configuration comprising four opposed dipole arm members coupled to and extending away from said second disk member in a second vertical direction away from said first disk member; and (v) at least one signal-coupling member coupled to said at least one signal access point and extending into said annular space; and a plurality of intercoupling-reduction disks separately positioned, each between two vertically adjacent sub-arrays, and each having an annular conductive surface.

9. An antenna system as in claim 8, wherein said plurality of sub-arrays includes a central sub-array, a plurality of upper sub-arrays positioned above the central sub-array and a plurality of lower sub-arrays positioned below said central sub-array, with a physical inversion of each of the upper sub-arrays relative to the lower sub-arrays.

10. An antenna system as in claim 9, wherein said sub-arrays include seven active sub-arrays, including a central, three lower (top lower, middle lower and bottom lower) and three upper sub-arrays (top upper, middle upper and bottom upper), and additionally comprising:

an excitation unit coupled to said signal port of each said active sub-array and arranged to couple excitation signals of the following relative phases to signal ports of those active sub-arrays:

central sub-array, zero degrees phase, lower sub-arrays, plus 90 degrees phase, and upper sub-arrays, plus 90 degrees phase;

said physical inversion effective to provide a 180 degree phase reversal of the radiation patterns of said upper sub-arrays relative to the radiation patterns of said lower sub-arrays.

11. An antenna system as in claim 10, wherein said excitation unit is arranged to couple excitation signals of the following relative amplitudes to the signal ports of said seven active sub-arrays:

top upper sub-array, 0.127;

middle upper sub-array, 0.212;

bottom upper sub-array, 0.637;

central sub-array, 1.0;

top lower sub-array, 0.637;

middle lower sub-array, 0.212;

bottom lower sub-array, 0.127.

12. An antenna system as in claim 8, wherein said annular space between the first and second disk members is configured as an annular slot excited by said at least one signal coupling member and arranged to couple signals to said first and second dipole-component configurations.

13. An antenna system as in claim 8, wherein:

said at least one coupling member comprises four vertical exciters; and said first conductive pattern comprises a four-way power divider configuration coupled to four said signal access points, with each signal access point coupled singly to one of said exciters.

14. An antenna system as in claim 8, wherein:

said first and second dipole-component configurations are arranged to together provide four dipoles, each said dipole having upward and downward extending arm members; and said first conductive configuration, with said signal-coupling member, are configured to provide excitation of said annular space to couple same phase excitation signals to each of said four dipoles.

15. An antenna system as in claim 8, additionally comprising:

an excitation unit coupled to said signal port of each of said active sub-arrays; and a plurality of passive sub-arrays separately positioned each between two vertically adjacent ones of said active sub-arrays to which the excitation unit is coupled;

said passive sub-arrays not coupled to said excitation unit.

16. An antenna system comprising:

a plurality of sub-arrays positioned along a vertically-extending central axis, each sub-array comprising:

(i) a first disk member including two main surfaces, a central opening and a first conductive configuration having a four-way power divider, a signal port and four signal access points;

(ii) a first dipole-component configuration comprising four dipole arm members coupled to and extending in a first vertical direction away from said first disk member at positions spaced from and around said central axis;

(iii) a second disk member including two main surfaces and a central opening and positioned with an annular space between the first and second disk members;

(iv) a second dipole-component configuration comprising four opposed dipole arm members coupled to and extending away from said second disk member in a second vertical direction away from said first disk member; and (v) at least one signal-coupling member comprising four vertical exciters, coupled to said four signal access points and extending into said annular space; and a plurality of intercoupling-reduction disks separately positioned, each between two vertically adjacent sub-arrays, and each having an annular conductive surface; and wherein, in said antenna system, said plurality of sub-arrays includes a central sub-array, a plurality of upper sub-arrays positioned above the central sub-array and a plurality of lower sub-arrays positioned below said central sub-array, with a physical inversion of each of the upper sub-arrays relative to the lower sub-arrays; and wherein said sub-arrays include seven active sub-arrays, including said central, three lower (top lower, middle lower and bottom lower) and three upper sub-arrays (top upper, middle upper and bottom upper), and additionally comprising:

an excitation unit coupled to said signal port of each said active sub-array and arranged to couple excitation signals of the following relative phases to signal ports of those active sub-arrays:

central sub-array, zero degrees phase, lower sub-arrays, plus 90 degrees phase, and upper sub-arrays, plus 90 degrees phase;

said physical inversion effective to provide a 180 degree phase reversal of the radiation patterns of said upper sub-arrays relative to the radiation patterns of said lower sub-arrays.

17. An antenna system as in claim 16, wherein said excitation unit is arranged to couple excitation signals of the following relative amplitudes to the signal ports of said seven active sub-arrays:

top upper sub-array, 0.127;

middle upper sub-array, 0.212;

bottom upper sub-array, 0.637 central sub-array, 1.0;

top lower sub-array, 0.637;

middle lower sub-array, 0.212;

bottom lower sub-array, 0.127.

18. An antenna system as in claim 16, wherein said annular space between the first and second disk members is configured as an annular slot excited by said at least one signal coupling member and arranged to couple signal to said first and second dipole-component configurations.

19. An antenna system as in claim 16, wherein:

said first and second dipole-component configurations are arranged to together provide four dipoles, each said dipole having upward and downward extending arm members; and said first conductive configuration, with said signal-coupling member, are configured to provide excitation of said annular space to couple same phase excitation signals to each of said four dipoles.

* * * * *